US006445895B2

(12) United States Patent
Shirasawa et al.

(10) Patent No.: US 6,445,895 B2
(45) Date of Patent: Sep. 3, 2002

(54) IMAGE FORMING APPARATUS HAVING A BELT ATTACHING/DETACHING MECHANISM

(75) Inventors: Satoshi Shirasawa, Ibaraki (JP); Kazutaka Sato, Ibaraki (JP); Isao Nakajima, Ibaraki (JP); Yukio Otome, Ibaraki (JP)

(73) Assignees: Hitachi Koki Co., Ltd., Tokyo (JP); Hitachi, Ltd., Tokyo (JP)

( * ) Notice: Subject to any disclaimer, the term of this patent is extended or adjusted under 35 U.S.C. 154(b) by 0 days.

(21) Appl. No.: 09/768,810

(22) Filed: Jan. 25, 2001

(30) Foreign Application Priority Data

Jan. 25, 2000 (JP) ..... 2000-015466

(51) Int. Cl.[7] ..... G03G 21/16; G03G 15/00
(52) U.S. Cl. ..... 399/116; 399/121; 399/165
(58) Field of Search ..... 399/116, 162, 399/165, 121, 302, 308

(56) References Cited

U.S. PATENT DOCUMENTS 4,634,264 A * 1/1987 Takahashi ..... 399/116
5,991,575 A * 11/1999 Okiyama et al. ..... 399/165

FOREIGN PATENT DOCUMENTS

| | | | |
|---|---|---|---|
| JP | 58-59462 | * | 4/1983 |
| JP | 62-27209 | * | 2/1987 |
| JP | 9-134107 | * | 5/1997 |
| JP | 11-119499 | * | 4/1999 |
| JP | 2001-13800 | * | 1/2001 |

* cited by examiner

*Primary Examiner*—Joan Pendegrass
(74) *Attorney, Agent, or Firm*—Sughrue Mion, PLLC

(57) ABSTRACT

In an image forming apparatus, attachment/detachment guide pins (10 and 11) are disposed on a side face of a belt cartridge (12). Attachment/detachment guide grooves (30, 31, and 32) which guide the attachment/detachment guide pins (10 and 11) are disposed in a frame (29) of a main unit of an image forming apparatus. A belt tension applying mechanism including a tension link (13) and a spring (15) is disposed on the side of the apparatus main unit. When the belt cartridge (12) is to be attached to the apparatus main unit, the cartridge is attached along the attachment/detachment guide grooves (30, 31, and 32), so that the rotation shaft of a tension roller (4) is easily and surely engaged with the belt tension applying mechanism (13 and 15).

7 Claims, 11 Drawing Sheets

IMAGE FORMING APPARATUS HAVING A BELT ATTACHING/DETACHING MECHANISM

BACKGROUND OF THE INVENTION

1. Field of the Invention

The present invention relates to an image forming apparatus such as an apparatus of the electrophotographic type, for example, a copier, a printer, or a facsimile apparatus, and particularly to a belt cartridge attaching and detaching mechanism for accommodating and replacing a belt. The belt which is to be replaced includes: a photosensitive belt on which an electrostatic latent image is to be formed; an intermediate transfer belt which once retains a toner image formed on a photosensitive member and then transfers the image onto a transfer member; and a transfer medium transport belt which transports such a transfer member.

2. Description of the Related Art

In an image forming apparatus of the electrophotographic type such as a copier, a printer, or a facsimile apparatus, an electrostatic latent image is written in the surface of a drum-like or belt-like photosensitive member which is uniformly charged, and the electrostatic latent image is developed by a toner. The toner image on the photosensitive member is directly transferred to a transfer medium such as a copy sheet, or the toner image on the photosensitive member is primary-transferred to an intermediate transfer belt and the transferred toner image is secondary-transferred to a transfer medium, so that a so-called hard copy of an image is obtained.

In such an image forming apparatus, the photosensitive belt, the intermediate transfer belt, and the transfer medium transport belt are worn in accordance with the use condition and deterioration with time, and therefore must be periodically replaced with a new one.

JP-A-8-123294 discloses a method wherein shafts between which a belt is stretched are movably configured so that replacement of the belt only can be performed.

It is known that, when the peripheral lengths of the ends in the width direction perpendicular to the transportation direction of the belt are different from each other or tensions are varied, the belt meanders. It is difficult to produce a belt so that the peripheral lengths of the ends in the width direction are equal to each other, and to balance tensions of the lateral or right and left sides with each other. Therefore, a mechanism in which the lateral ends of rollers are enabled to be moved in any direction, and a spring is attached to each of the ends so as to make proper the tensions of the right and left sides of the belt, or which corrects meandering is required.

JP-A-57-60356 discloses a method in which a restricting member is disposed in the vicinity of an end of a roller to prevent a belt from meandering. When the belt meanders in a larger degree, however, the belt rides over a stopper so that the belt is wrinkled or the belt itself is damaged.

JP-A-4-133926 discloses a method in which a tapered ring is coupled with the shaft of a steering roller, and the steering roller is tilted in accordance with a force which is produced by meandering of a belt to cause the tapered ring to be forcedly rotated, thereby correcting meandering.

However, it is difficult to take out only the belt from the complicated inner space of the apparatus. In attachment of a belt, the belt may be damaged. Since shafts between which the belt is stretched are moved, the parallelism between the shafts must be accurately adjusted at each replacement of a belt.

In the above-mentioned structures of the conventional art, when a disposal belt cartridge is used, also many gears and clutches which are disposed in the belt cartridge are replaced and junked together with other components. This is very uneconomical from the viewpoints of saving of resources and the cost. Therefore, the structures are not suitable for the disposal type. Also in the case of a recycling belt cartridge, a prolong time period is required for recycling and checking because of the complicated structure of the belt cartridge. Therefore, the structures are not suitable also for the recycling type.

When the degree of meandering is changed during operation or the ability of correcting meandering becomes in sufficient owing to deterioration with time, meandering of a belt cannot be sometimes completely corrected.

SUMMARY OF THE INVENTION

It is an object of the invention to provide an image forming apparatus which is of the type wherein, in replacement of a belt, the belt is replaced together with a belt cartridge, in which the structure of the belt cartridge is simplified and the number of components is reduced, and which has a structure that, in the case of the disposal type, the amount of waste matter is reduced, and in the case of the recycling type, the time period and man power required for recycling and checking can be reduced so that the total running cost can be lowered.

It is another object of the invention to provide an image forming apparatus which is of the type wherein only a belt is replaced, and which comprises a tension applying/releasing mechanism that causes a belt tension applying mechanism and a tension roller to be engaged with and disengaged from each other.

It is a further object of the invention to provide an image forming apparatus which comprises a belt meandering correcting mechanism that accurately corrects meandering of a belt.

In order to attain the object, the invention provides an image forming apparatus in which a belt cartridge incorporating a belt and plural rolls that support the belt is detachably mounted in a main unit of the image forming apparatus to enable the belt to be replaced, wherein at least one of the plural rolls is a tension roller in which a rotation shaft is movable in a direction along which predetermined tension is applied to the belt, the belt cartridge comprises an attachment/detachment guide pin which is used in attachment to and detachment from the main unit of the image forming apparatus, the main unit of the image forming apparatus comprises a belt tension applying mechanism which moves the tension roller to apply predetermined tension to the belt, and a guide groove which is used in attachment and detachment of the belt cartridge, and in attachment of the belt cartridge, the attachment/detachment guide pin is guided by the attachment/detachment guide groove, and the belt tension applying mechanism is engaged with the rotation shaft of the tension roller to apply the predetermined tension to the belt.

In the invention, the belt tension applying mechanism which moves the tension roller to apply predetermined tension to the belt, and the guide groove which is used in attachment and detachment of the belt cartridge are disposed on the side of the main unit of the image forming apparatus. In the case where the belt cartridge is of the disposal type, therefore, it is not required to dispose many gears and clutches in the belt cartridge, and hence the number of parts to be junked together with other components is largely reduced. Therefore, it is possible to obtain a structure which is preferable and economical from both the viewpoints of saving of resources and the cost. In the case where the belt cartridge is of the recycling type, the structure of the belt cartridge is simplified so that works of recycling and checking require little time period and man power.

In order to attain the other object, the invention provides an image forming apparatus in which a belt is singly attachable to and detachable from the plural belt support rolls, wherein at least one of the plural rolls is a tension roller in which a rotation shaft is movable in a direction along which predetermined tension is applied to the belt, a main unit of the image forming apparatus comprises a belt tension applying mechanism which moves the tension roller to apply the predetermined tension to the belt, and in attachment of the belt, the belt tension applying mechanism is engaged with the rotation shaft of the tension roller to apply the predetermined tension to the belt.

Also, in the invention, the belt tension applying mechanism which moves the tension roller to apply predetermined tension to the belt is disposed on the side of the main unit of the image forming apparatus. Therefore, mechanism in a region enclosed by the belt has a simplified structure, whereby cumbersome in checking of the mechanism in the narrow region can be eliminated.

In order to attain the further object, in both the above-mentioned image forming apparatuses, the apparatus comprises: a meandering detecting sensor for the belt; and a belt meandering correcting mechanism which, based on a detection result of the meandering detecting sensor, drives the belt tension applying mechanism to correct meandering.

When the meandering detecting sensor and the belt meandering correcting mechanism are provided in this way, meandering of the belt can be automatically corrected in a sufficient manner even when the degree of meandering is changed during operation or the ability of correcting meandering becomes in sufficient owing to deterioration with time.

The belt may be either of a photosensitive belt, an intermediate transfer belt, and a transfer medium transport belt.

DETAILED DESCRIPTION OF THE PREFERRED EMBODIMENTS

Now, embodiments of the image forming apparatus of the invention will be described with reference to FIGS. 1 to 9.

(Embodiment 1)

Figure 1:
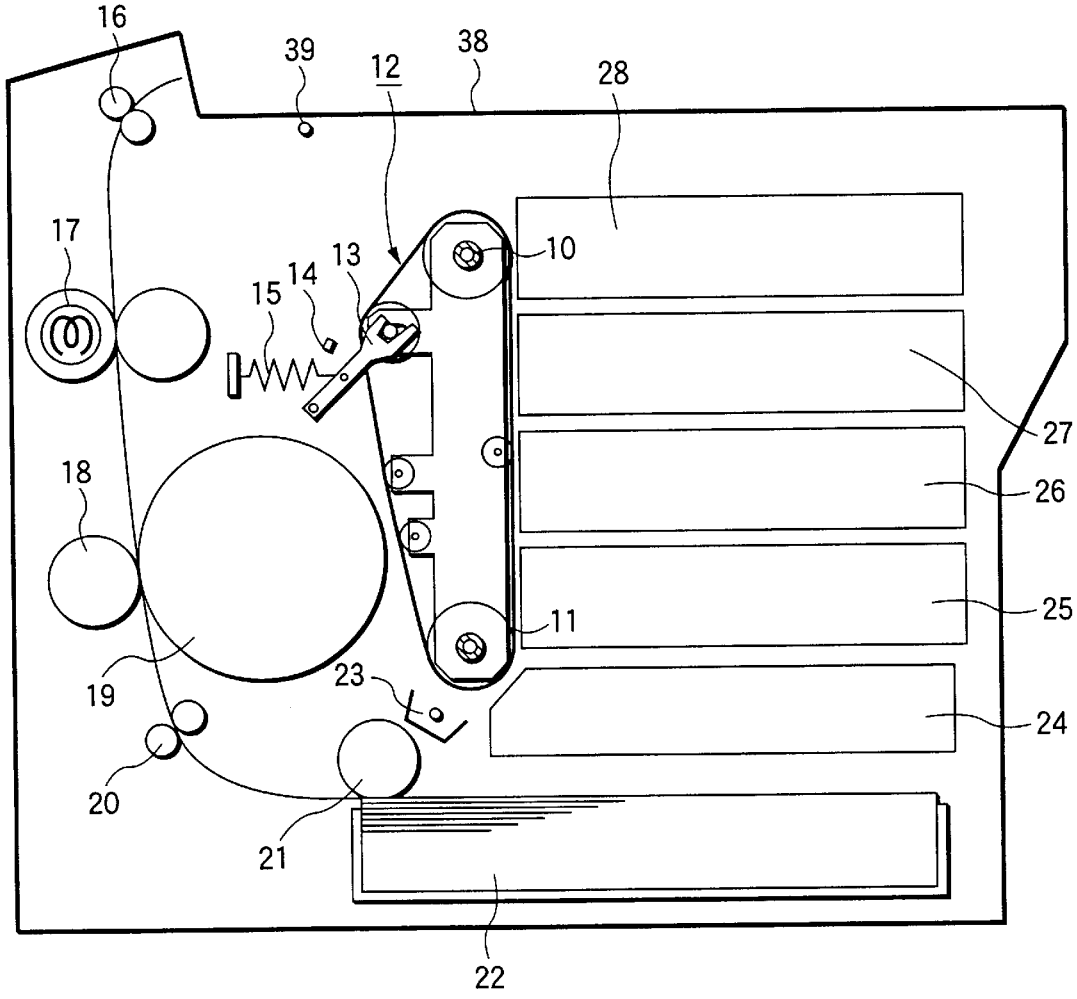
FIG. 1 is a view schematically showing the structure of a color laser printer which is Embodiment 1 of the image forming apparatus according to the invention.

FIG. 1 is a view schematically showing the structure of a color laser printer which is Embodiment 1 of the image forming apparatus of the electrophotographic type according to the invention.

In FIG. 1, a photosensitive belt cartridge 12 is shown in a state where the cartridge is attached with being guided by attachment/detachment guide pins 10 and 11. Predetermined tension is applied to a photosensitive belt (see FIG. 2) by a belt tension applying mechanism including a tension link 13, a stopper guide 14, and a spring 15.

The photosensitive belt (see FIG. 2) which is accommodated in the photosensitive belt cartridge 12 is charged by a charger 23, and exposed to image light by a laser writing unit 24 on the basis of image data sent from a personal computer or the like which is not shown, and retains an electrostatic latent image.

Developing units 25, 26, 27, and 28 respectively contain developing agents of different colors, for example, yellow, magenta, cyan, and black, and are arranged so as to be opposed to the photosensitive belt cartridge 12. The developing units 25 to 28 develop the electrostatic latent image on the exposed photosensitive belt 1 by the non-contact developing method. The developed image is transferred from the photosensitive belt 1 to an intermediate transfer belt 19, to be retained thereon in a state where the colors are superimposed with one another.

On the other hand, transfer media such as copy sheets which are accommodated in a sheet supply cassette 22 are separated into individual ones by a separation roller 21. Each transfer medium is passed over a transport roller 20 and then supplied between the intermediate transfer belt 19 and a backup roller 18. The backup roller 18 cooperates with the intermediate transfer belt 19 to electrostatically transfer the toner image formed on the intermediate transfer belt 19, to the transfer medium.

The image is fixed by a fixing roller 17 to the transfer medium to which the image has been electrostatically transferred. The transfer medium is then discharged by a transport roller 16 onto the upper face of the main unit of the apparatus.

When the photosensitive belt cartridge 12 is to be attached or detached, an upper cover 38 is rotated in a counterclockwise direction about a fulcrum 39 so as to be largely opened. Therefore, attachment or detachment of the photosensitive belt cartridge 12, and maintenance of the interior of the apparatus main unit can be conveniently performed.

In the embodiment, the invention has been described with taking a color laser printer as an example. Therefore, the printer has the plural developing units 25, 26, 27, and 28. In the invention, the number of developing units is not restricted. Therefore, the invention can be applied also to a monochrome laser printer, etc.

Figure 2:
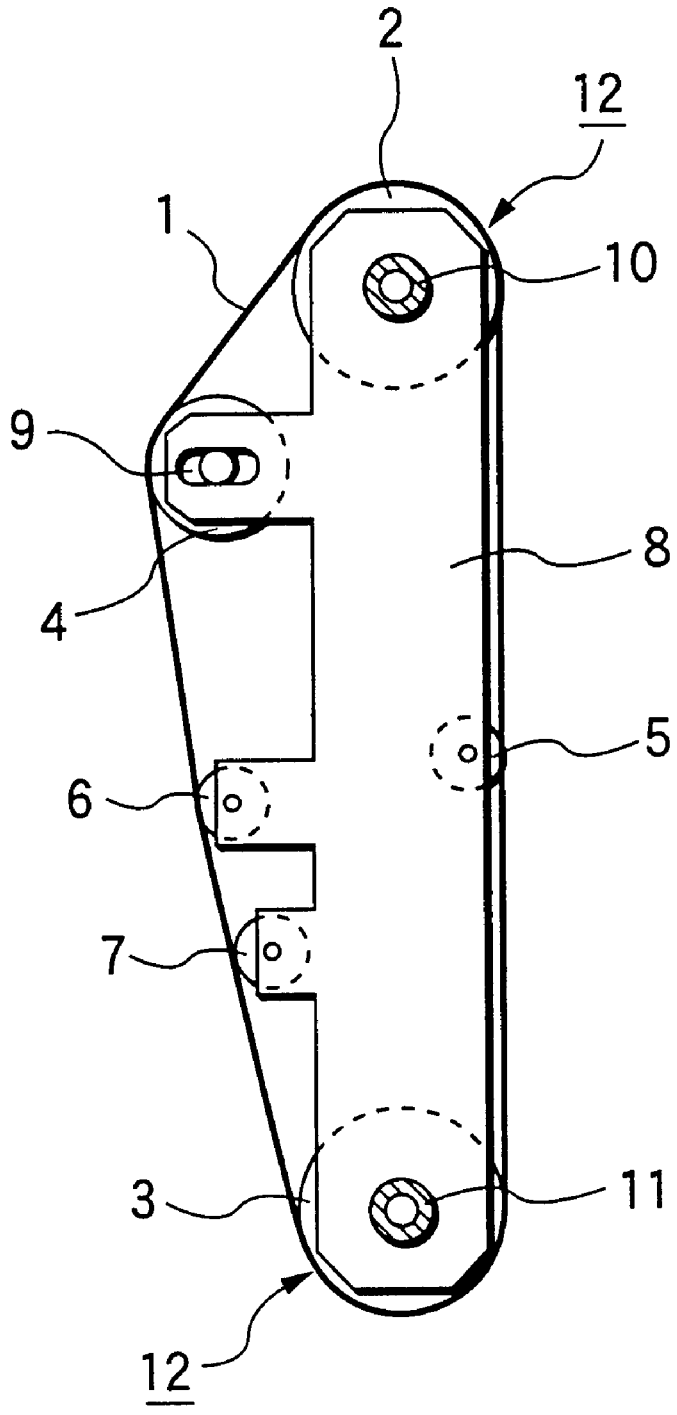
FIG. 2 is a view schematically showing the internal configuration of a photosensitive belt cartridge 12.

FIG. 2 is a view schematically showing the internal configuration of the photosensitive belt cartridge 12. The photosensitive belt cartridge 12 is configured by the photosensitive belt 1, a driving roller 2, a driven roller 3, a tension roller 4, guide rollers 5, 6, and 7, a frame 8 which holds rotation shafts of these rollers, a guide groove 9 which movably holds the rotation shaft of the tension roller 4, and attachment/detachment guide pins 10 and 11.

The photosensitive belt 1 on which an electrostatic latent image is to be formed is stretched among the driving roller 2, the driven roller 3, and the tension roller 4 for applying predetermined tension to the photosensitive belt 1. In FIG. 2, the belt is driven in a counterclockwise direction.

The rotation shafts of the guide rollers 5, 6, and 7 are fixed to the frame 8, and are in contact with the inner periphery of the photosensitive belt 1 to guide the belt. The rotation shaft of the tension roller 4 is movable along the guide groove 9 formed in the frame 8, in a substantially horizontal direction in the figure.

When the photosensitive belt cartridge 12 is to be attached to or detached from the main unit of the apparatus, the attachment/detachment guide pins 10 and 11 restrict the position of the photosensitive belt cartridge 12.

Figure 3:
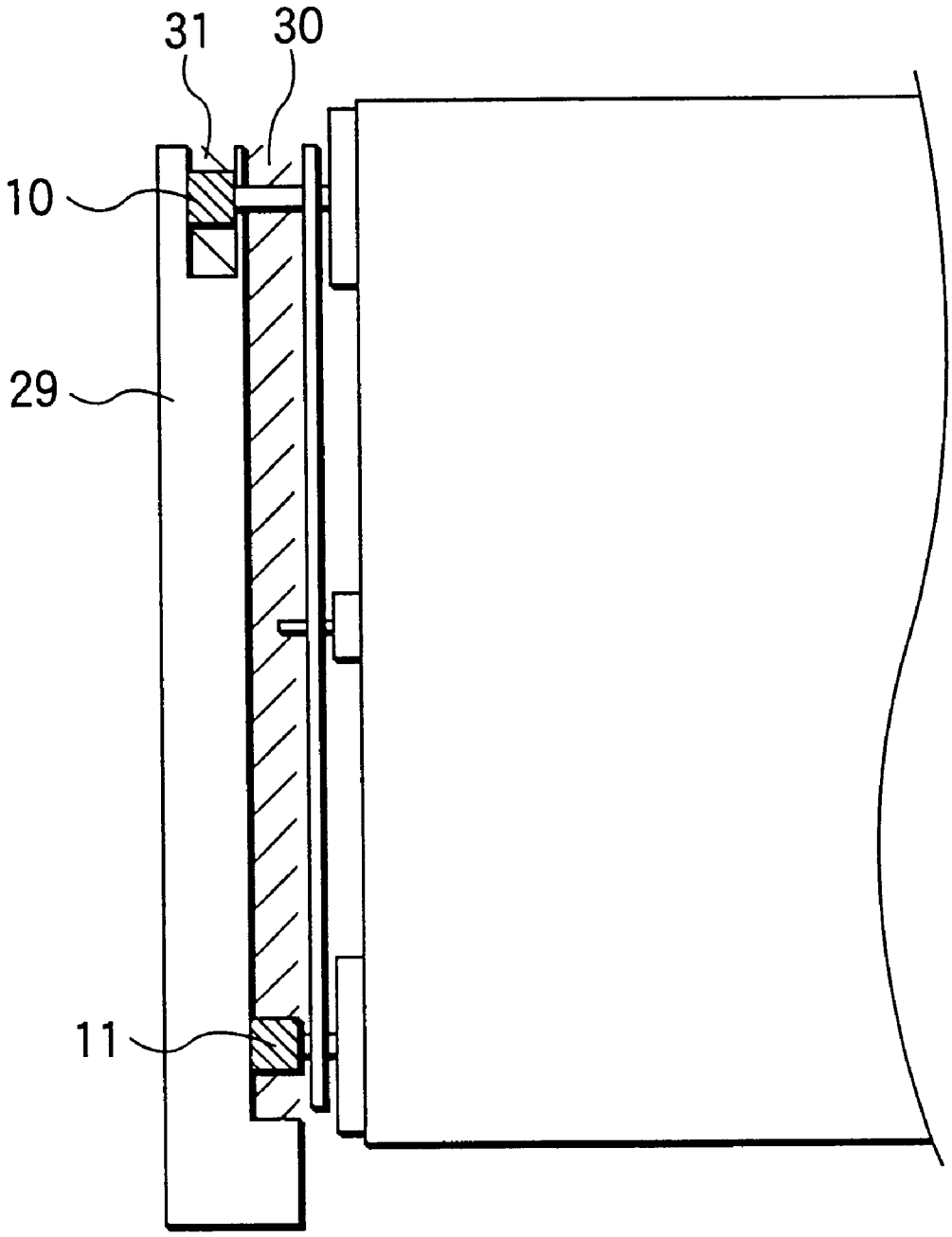
FIG. 3 is a view showing a state where attachment/detachment guide pins 10 and 11 of the photosensitive belt cartridge 12 enter attachment/detachment guide grooves 31 and 30 of the main unit of the image forming apparatus, respectively.

FIG. 3 is a view of a left end portion of the photosensitive belt cartridge 12 as seen from the front side, and showing a state where the attachment/detachment guide pins 10 and 11 of the photosensitive belt cartridge 12 enter attachment/detachment guide grooves 31 and 30 of the main unit of the image forming apparatus, respectively. The photosensitive belt cartridge 12 comprises the lateral pair of attachment/detachment guide pins 10 and 11 which are coaxial with the driving roller 2 and the driven roller 3, respectively. The attachment/detachment guide pins 10 and 11 are attached at different positions in the width direction, and enter the attachment/detachment guide grooves 31 and 30 which are formed at different positions in the width direction of a frame 29 of the main unit of the image forming apparatus, respectively.

Figure 4:
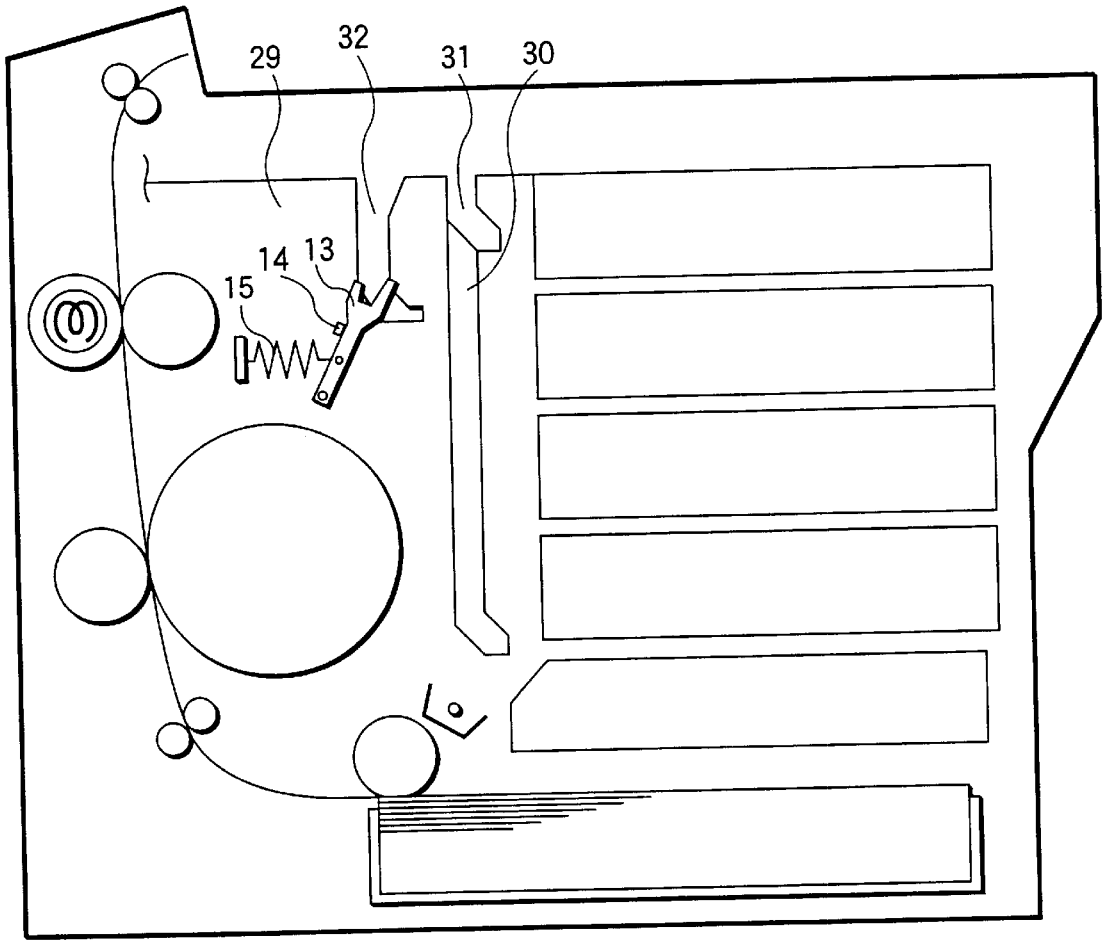
FIG. 4 is a view showing an example of the shapes of attachment/detachment guide grooves 30, 31, and 32 which are formed in a frame 29 of the main unit of the image forming apparatus.

FIG. 4 is a view showing an example of the shapes of attachment/detachment guide grooves 30, 31, and 32 which are formed in the frame 29 of the main unit of the image forming apparatus. The attachment/detachment guide grooves 30, 31, and 32 which are disposed in the side frame 29 of the main unit of the image forming apparatus have a shape in which a vertical groove portion is combined with an obliquely downward groove portion. At the same time when the attachment/detachment guide pins 10 and 11 enter the attachment/detachment guide grooves 31 and 30 of the main unit of the image forming apparatus as shown in FIG. 3, also the rotation shaft of the tension roller 4 shown in FIG. 2 enters the attachment/detachment guide groove 32 shown in FIG. 4, so that the photosensitive belt cartridge 12 is held at a predetermined position.

When the photosensitive belt cartridge 12 is not attached, the tension link 13 is pulled by the force of the spring 15 to abut against the stopper guide 14. In this state, a notch formed in the forward end of the tension link 13 is positionally coincident with the attachment/detachment guide groove 32.

Next, referring to FIGS. 5, 6, and 7, the procedure of attaching the photosensitive belt cartridge will be described. The main unit of the image forming apparatus is configured so that, when the upper cover 38 is rotated in a counterclockwise direction about the fulcrum 39, the upper portion of the main unit of the image forming apparatus is largely opened. In this state, the photosensitive belt cartridge 12 is attached or detached.

Figure 5:
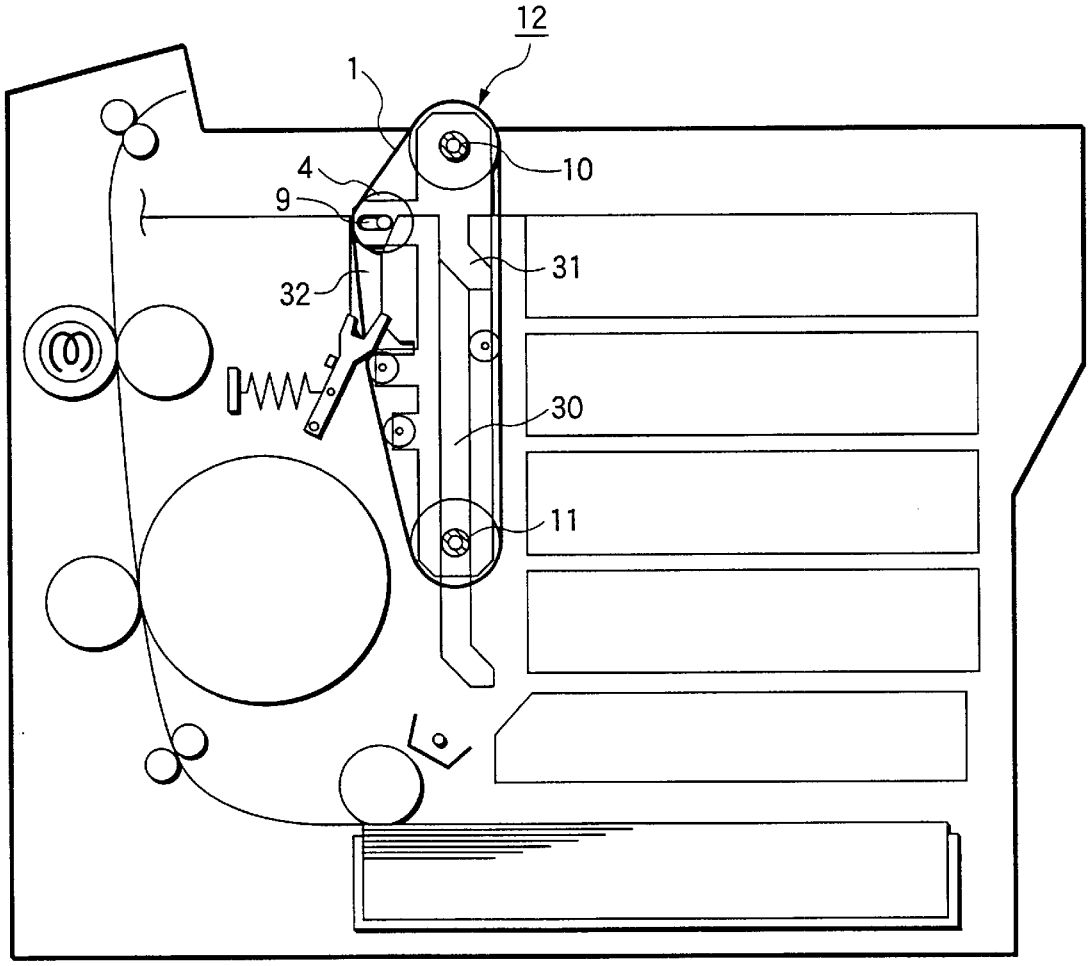
FIG. 5 is a view showing procedure 1 of attaching the photosensitive belt cartridge.

First, as shown in FIG. 5, the photosensitive belt cartridge 12 is inserted so that the attachment/detachment guide pin 11 is moved along the attachment/detachment guide groove 30. When further inserted, the rotation shaft of the tension roller 4 which is movable along the guide groove 9 abuts against an upper portion of the attachment/detachment guide groove 32 which is widened in a tapered manner. As the cartridge is further inserted, the shaft is pushed more leftward in the figure.

Figure 6:
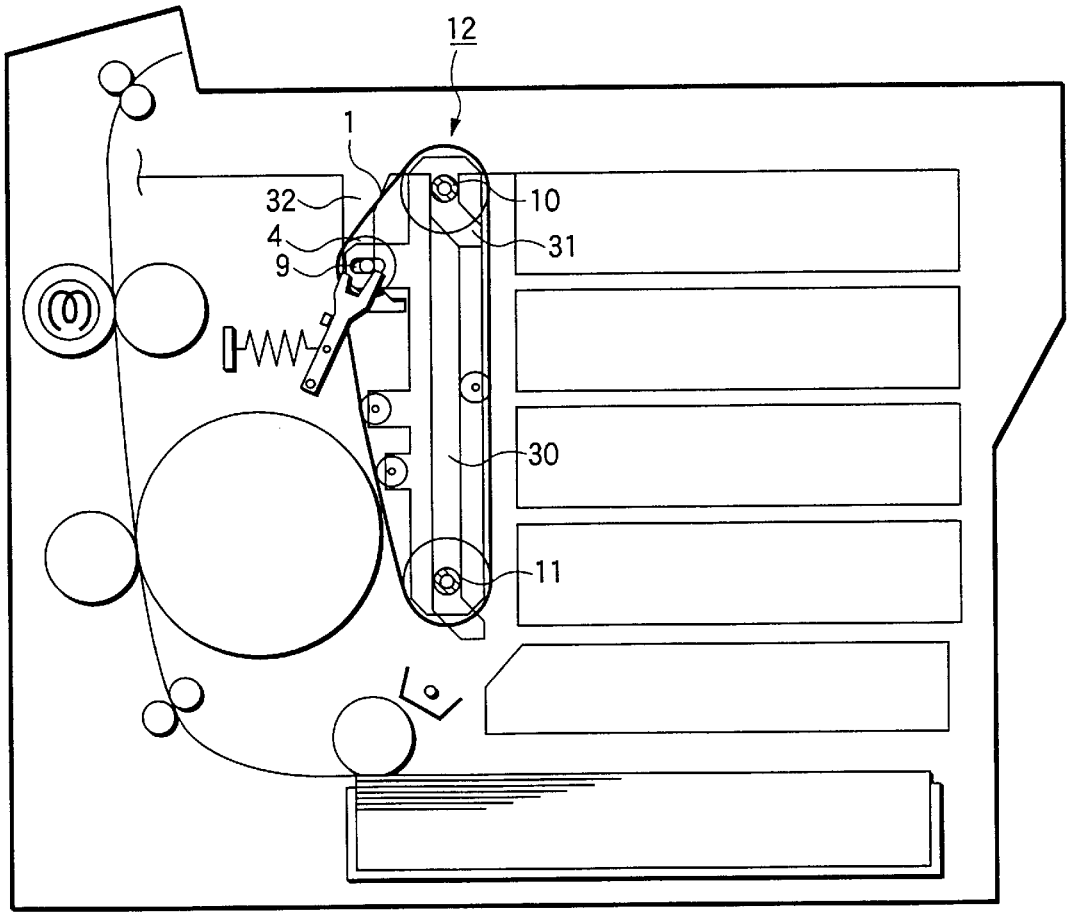
FIG. 6 is a view showing procedure 2 of attaching the photosensitive belt cartridge.
Figure 7:
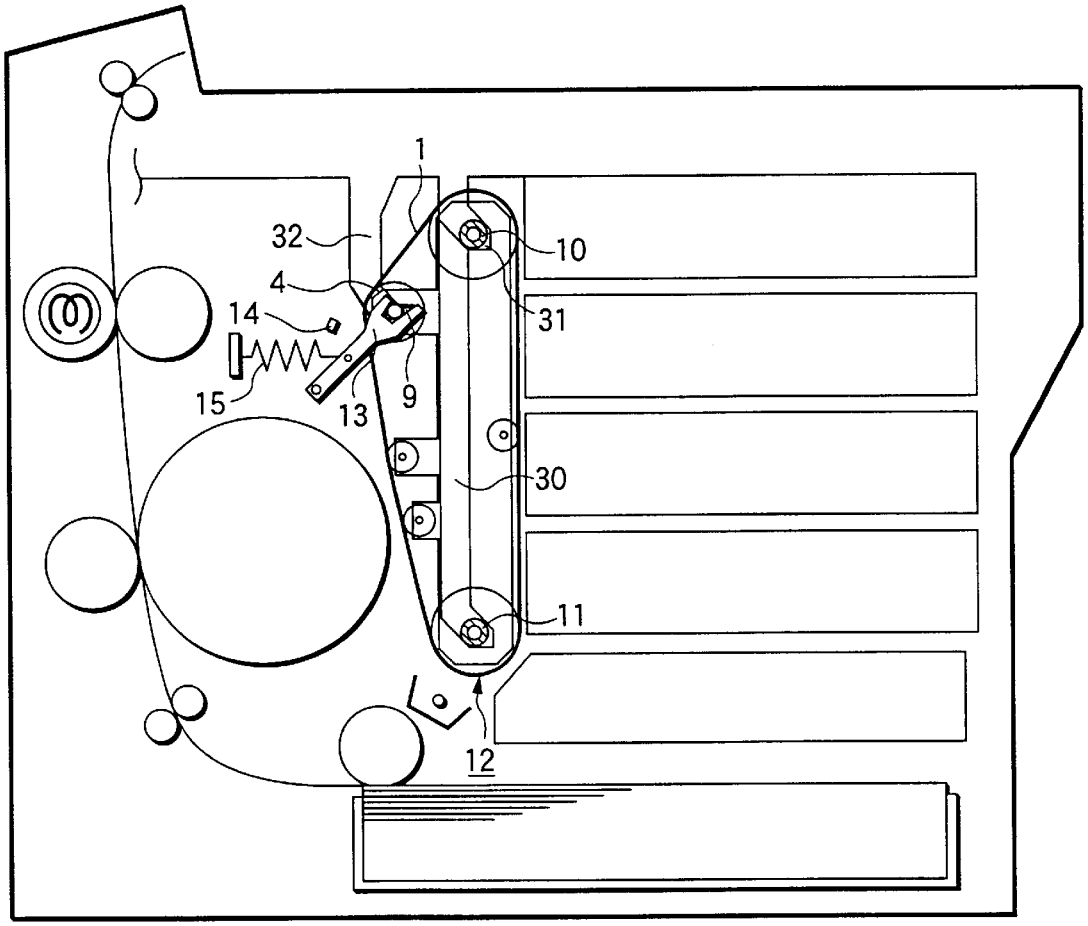
FIG. 7 is a view showing procedure 3 of attaching the photosensitive belt cartridge.

Next, as shown in FIG. 6, the attachment/detachment guide pin 10 is inserted into the attachment/detachment guide groove 31. The rotation shaft of the tension roller 4 is engaged with the notch of the tension link 13 to press down the tension link 13. As a result of the operation, the spring 15 is extended, and the tension link 13 is pulled by the tensile spring force to apply tension to the belt 1.

When further inserted, the rotation shafts of the attachment/detachment guide pins 10 and 11 and the tension roller 4 reach the respective obliquely downward groove portions of the attachment/detachment guide grooves 30, 31, and 32, and the photosensitive belt cartridge 12 is obliquely downward lowered in accordance with the shapes of the attachment/detachment guide grooves 30, 31, and 32. As a result, the cartridge is held at the position shown in FIG. 7.

At this time, the tension roller 4 is further pulled out by the tension link 13, so that predetermined tension which is suitable for belt driving is applied to the photosensitive belt 1. Although not shown, a driving gear of the driving roller 2 which is coaxial with the attachment/detachment guide pin 10 meshes with a gear of a power unit of the main unit of the image forming apparatus, thereby completing attachment of the photosensitive belt cartridge 12 to the main unit of the image forming apparatus. The photosensitive belt cartridge 12 is locked by a releasable lock lever which is automatically engaged therewith after attachment to the main unit of the image forming apparatus, to be restricted to a predetermined position, whereby the meshing state of the gears is maintained.

The method of taking out the photosensitive belt cartridge 12 from the main unit of the image forming apparatus is performed in a sequence opposite to that of the attachment. Namely, when the photosensitive belt cartridge 12 is pulled up, the cartridge can be easily taken out from the main unit of the image forming apparatus.

Next, referring to FIG. 1, the process of forming a color image in the image forming apparatus of Embodiment 1 will be described. Data of a color image are calculated by using a personal computer or the like to produce image data of each color. The image data are input to the image forming apparatus of FIG. 1.

When a color signal of one of the colors is input to the laser writing unit 24, a laser beam which is generated by a semiconductor laser of the laser writing unit 24 is projected to the peripheral face of the photosensitive belt 1 that has been uniformly charged by the charger 23, thereby forming a bright line.

When scanning is started, the beam is detected by an index sensor, beam modulation due to a first color signal is started, and the peripheral face of the photosensitive belt 1 is scanned by the modulated beam. In accordance with the main scanning due to the laser beam and the sub scanning due to transportation of the photosensitive belt 1, therefore, a latent image corresponding to the first color is formed in the peripheral face of the photosensitive belt 1.

The latent image is developed by one of developing means, i.e., the developing unit 28 which is filled with a toner (developing medium) of yellow (Y), to be formed as a toner image on the surface of the photosensitive belt 1.

The obtained toner image is transported to the intermediate transfer belt 19 while being retained to the surface of the photosensitive belt 1, and then transferred to the intermediate transfer belt 19.

After the transfer of the toner image, the photosensitive belt 1 is again uniformly changed by the charger 23, and a second color signal output from a signal processing section is input to the laser writing unit 24. In the same manner as the case of the first color signal, writing is performed on the surface of the photosensitive belt to form a latent image.

The latent image is developed by the developing unit 27 which is filled with a toner of a second color or magenta (M). The toner image of magenta (M) is transferred to the intermediate transfer belt 19 to be superimposed to the toner image of yellow (Y) which has been already formed.

Similarly, a toner image of cyan (C) is formed by the developing unit 26 which is filled with a toner of cyan (C), and then transferred, and a toner image of black is formed by the developing unit 25 which is filled with a toner of black, to be superimposed on the intermediate transfer belt 19, thereby forming a color toner image.

The color toner image which is formed on the peripheral face of the intermediate transfer belt 19 is transferred to a transfer medium.

Transfer media are sent one by one into a sheet supply path by means of friction with a sheet supply roller 21, from the sheet supply cassette 22 below the developing units 25 to 28, passed over the transport roller 20, and then supplied to the intermediate transfer belt 19 with making the passing timing of the forward end of the transfer medium coincident with the image formation position on the intermediate transfer belt 19.

The transfer medium which has been supplied to the intermediate transfer belt 19 and to which the image has been transferred is subjected to fusion and fixation of the image by the fixing roller 17, passed over a discharge roller 16, and then discharged to a discharge tray to be stacked thereon.

By repeating the above-mentioned process, the color image can be printed out at a desired number.

(Embodiment 2)

Figure 8:
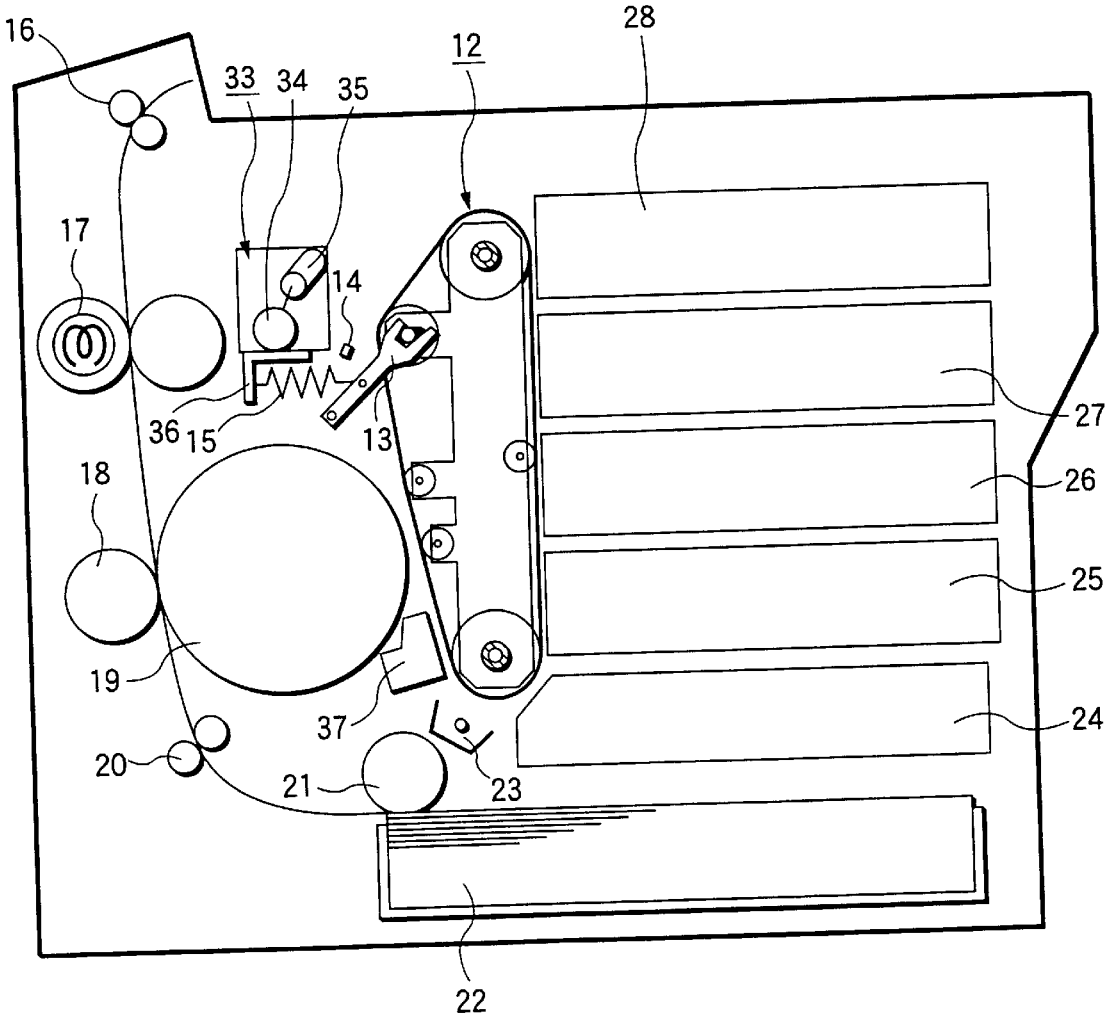
FIG. 8 is a view showing the configuration of Embodiment 2 of the image forming apparatus according to the invention.

FIG. 8 is a view schematically showing the configuration of Embodiment 2 of the image forming apparatus according to the invention. Embodiment 2 is an example in which the image forming apparatus of Embodiment 1 is modified so as to further comprise a meandering detecting sensor for the belt, and a belt meandering correcting mechanism which, based on a detection result of the meandering detecting sensor, drives the belt tension applying mechanism to correct meandering.

Referring to FIG. 8, the meandering detecting sensor 37 detects an unbalanced state of the photosensitive belt 1 in the photosensitive belt cartridge 12. In Embodiment 2, a CCD linear array sensor is used as the meandering detecting sensor. Alternatively, a laser displacement detecting sensor, an ultrasonic distance sensor, a two-dimensional CCD cameral sensor, or the like may be used.

A linear stage 36 fixes and holds one end of the spring 15. The belt meandering correcting mechanism 33 includes a stage driving gear 34 and a meandering control motor 35.

Figure 9:
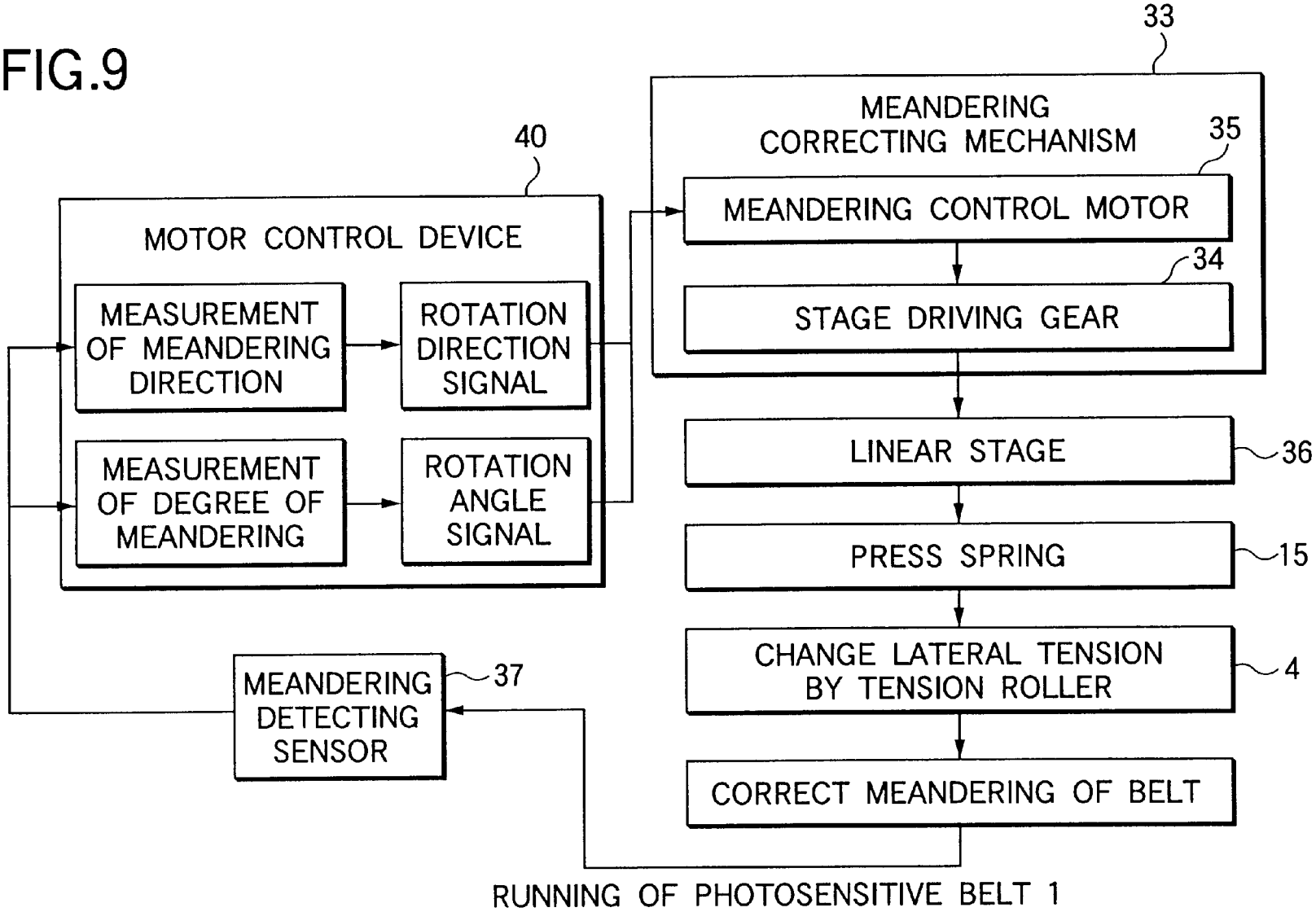
FIG. 9 is a block diagram showing an example of the configuration of a meandering correction control system for a photosensitive belt 1.

FIG. 9 is a block diagram showing an example of the configuration of a meandering correction control system for the photosensitive belt 1. Referring to FIG. 9, a motor control device 40 calculates the direction and degree of meandering of the photosensitive belt 1 based on an unbalance detection signal supplied from the meandering detecting sensor 37, and, on the basis of the calculated meandering direction and degree, outputs a rotation direction signal and a rotation angle signal to the meandering control motor 35 in the belt meandering correcting mechanism 33.

Specifically, on the basis of information of the position of the end of the photosensitive belt 1 which is detected by the meandering detecting sensor 37, command values for the direction and degree of meandering of the photosensitive belt 1 are calculated. In accordance with the meandering direction, the rotation direction of the meandering control motor 35 is switched over, and, when the meandering degree is not 0, the rotation angle signal corresponding to the meandering degree is output.

The meandering control motor 35 drives the linear stage 36 via the stage driving gear 34. When the linear stage 36 is driven and the spring 15 is extended or contracted in an arbitrary direction, the spring force is changed. The spring force of the spring 15 acts on the photosensitive belt 1 via the tension link 13 and the tension roller 4 to adjust the lateral tension of the photosensitive belt 1, thereby adjusting the unbalance of the belt.

When this adjustment is performed during the process of forming an image, the image can be accurately formed and color toners can be correctly placed, so that an output image of high quality can be obtained.

In the embodiments described above, the structure in which the spring 15 is extended and contracted is employed. Alternatively, the spring 15 may not be used, and the linear stage 36 may directly drive the tension link 13 to control the lateral tension of the photosensitive belt 1.

A mechanism which uses friction may be used as the meandering detecting mechanism, and the tension link 13 is moved by means of friction.

In the above, the embodiments using a photosensitive belt cartridge have been described. The invention may be applied also to an image forming apparatus using an intermediate transfer belt cartridge in which the belt is an intermediate transfer belt, or a transfer medium transport belt cartridge in which the belt is a transfer medium transport belt.

Figure 10:
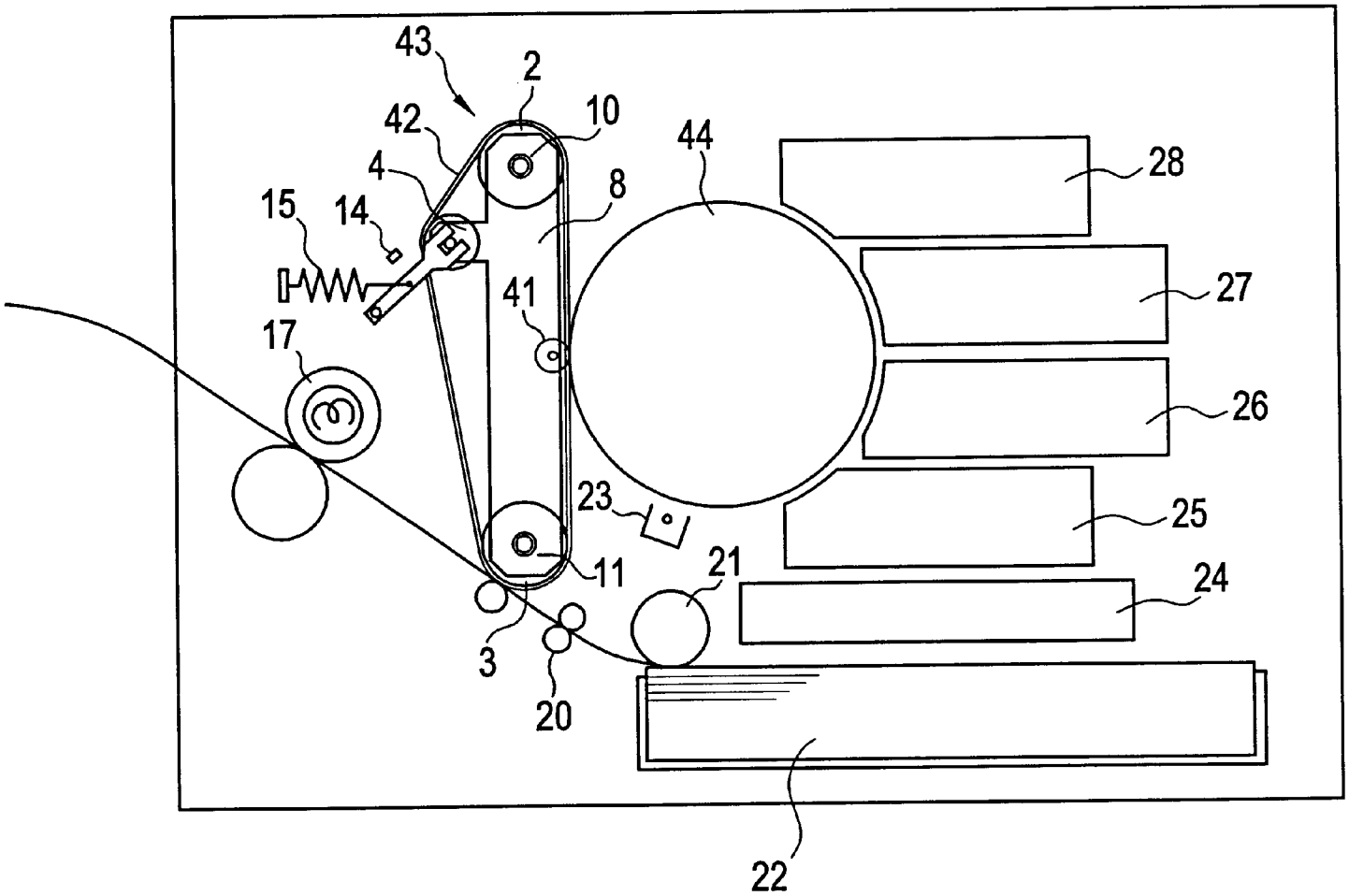
FIG. 10 is a view schematically showing the structure of a color laser printer using an intermediate transfer belt cartridge and a photosensitive body.

FIG. 10 shows the structure of a color laser printer using an intermediate transfer belt cartridge 43 and a photosensitive body 44 which is another embodiment of the image forming apparatus. The intermediate transfer belt cartridge 43 has a transfer unit 41 and an intermediate transfer belt 43.

Figure 11:
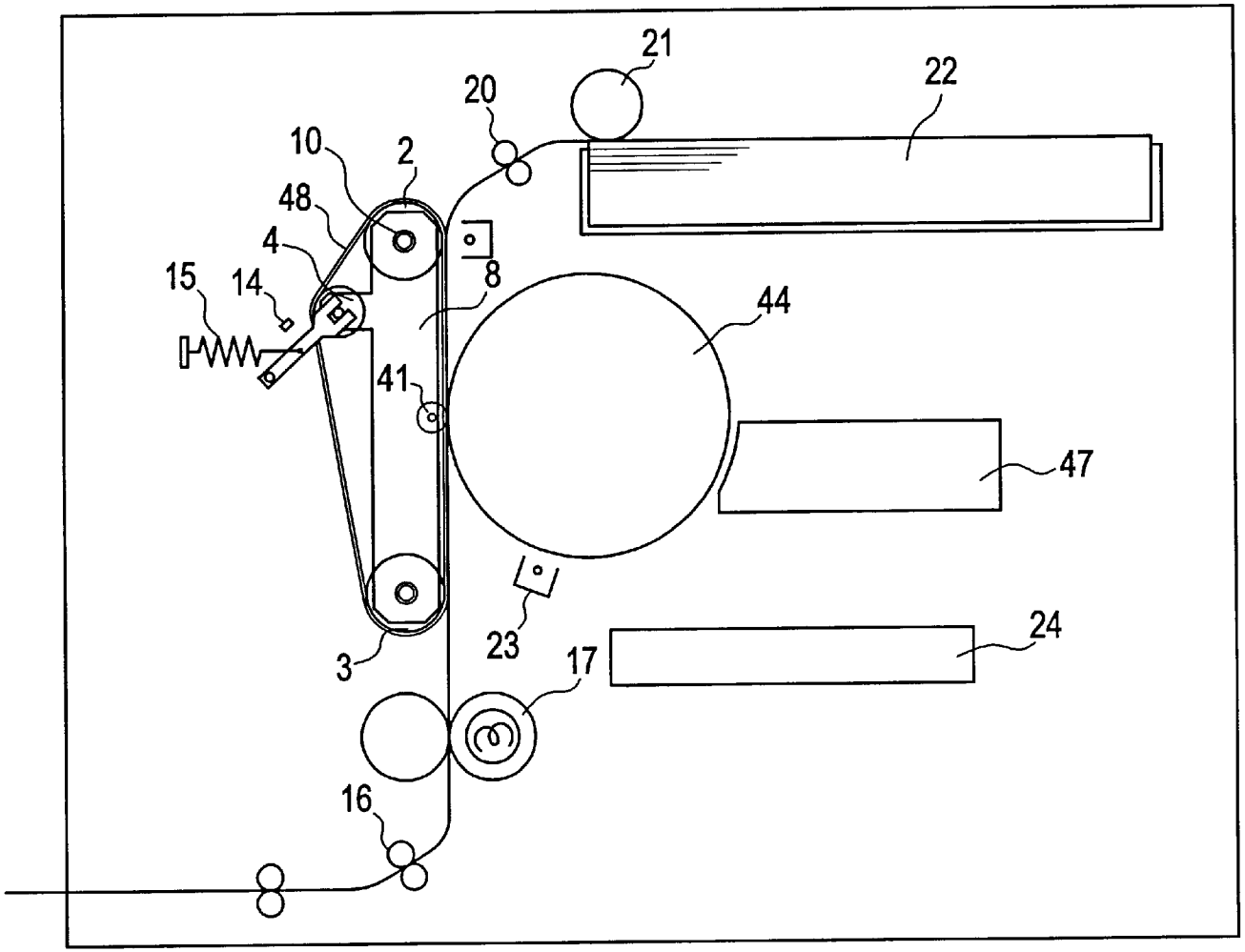
FIG. 11 is a view schematically showing the structure of a laser printer using a transfer medium transport belt cartridge and a photosensitive body.

FIG. 11 shows the structure of a laser printer using a transfer medium transport belt cartridge 48 and a photosensitive body 44 which is another embodiment of the image forming apparatus.

The intermediate transfer belt cartridge 43 and the transfer medium transport belt cartridge 48 have the same attachment/detachment structure as that of the photosensitive belt cartridge 12 shown in FIG. 1. Further, a belt tension giving mechanism and the attachment/detachment groove at the printer body side shown in FIGS. 10 and 11 also have the same structures as those shown in FIG. 1.

In the above embodiments, the image forming apparatuses in which a belt cartridge is employed have been described. The belt tension applying mechanism and the belt meandering correcting mechanism in the invention may be applied also to an image forming apparatus in which a belt cartridge is not used and replacement of a belt only is enabled, in the following manner.

A description will be made with reference to the configuration of FIG. 1. In an image forming apparatus in which replacement of a belt only is enabled, when the belt is to be replaced, the spring 15 is detached from the tension link 13, the tension link 13 is disconnected from the shaft of the tension roller 4, and the tension link 13 is retracted to a position where the link does not interfere with the belt. As a result, the shaft of the tension roller 4 is moved, and the application of tension on the photosensitive belt 1 is canceled, so that the belt can be easily replaced.

According to the invention, various belts constituting an image forming apparatus, such as a photosensitive belt, an intermediate transfer belt, and a transfer medium transport belt can be easily replaced in the form of a belt cartridge with new one. Furthermore, constituting members can be individually driven by a driving device of the main unit of the image forming apparatus. Therefore, a belt cartridge in which the number of components to be replaced together with the belt is reduced, and an image forming apparatus using such a belt cartridge can be provided.

According to the invention, an image forming apparatus can be provided in which various belts constituting the image forming apparatus, such as a photosensitive belt, an intermediate transfer belt, and a transfer medium transport belt can be easily replaced in the form of a belt cartridge with new one, and in which unbalance of such a belt can be corrected, and transportation which is correct and stable is enabled.

What is claimed is:

1. An image forming apparatus, comprising:

a main body; and a belt cartridge including a belt and rollers that support said belt, said belt cartridge being detachably mounted in said main body to enable said belt to be replaced;

wherein at least one of said rollers comprises a tension roller in which a rotation shaft is movable in a direction along which a predetermined tension is applied to said belt;

wherein said belt cartridge comprises an attachment/detachment guide pin which is used in attachment to and detachment from said main body;

wherein said main body includes a belt tension applying mechanism which moves said tension roller to apply predetermined tension to said belt, and a guide groove which is used in attachment and detachment of said belt cartridge; and wherein in attachment of said belt cartridge, said attachment/detachment guide pin is guided by said attachment/detachment guide groove, and said belt tension applying mechanism is engaged with said rotation shaft of said tension roller to apply the predetermined tension to said belt.

2. An image forming apparatus according to claim 1, wherein said apparatus further comprises:

a meandering detecting sensor for said belt; and a belt meandering correcting mechanism which, based on a detection result of said meandering detecting sensor, drives said belt tension applying mechanism to correct meandering.

3. An image forming apparatus according to claim 1, wherein said belt is a photosensitive belt.

4. An image forming apparatus according to claim 1, wherein said belt is an intermediate transfer belt.

5. An image forming apparatus according to claim 1, wherein said belt is a transfer medium transport belt.

6. An image forming apparatus according to claim 1, wherein said belt tension applying mechanism includes a spring, a stopper guide and a tension link, disposed on said main body.

7. An image forming apparatus comprising:

belt support rollers;

a belt attachable to and detachable from said belt support rollers, wherein at least one of said belt support rollers is a tension roller in which a rotation shaft is movable in a direction along which a predetermined tension is applied to said belt; and a main body for receiving said belt support rollers and said belt, said main body including a belt tension applying mechanism which moves said tension roller to apply the predetermined tension to said belt when said belt support rollers are disposed in said main body, wherein in attachment of said belt to said belt support rollers, said belt tension applying mechanism is engaged with said rotation shaft of said tension roller to apply the predetermined tension to said belt and in detachment of said belt from said belt support rollers, said belt tension applying mechanism is disengaged from said rotation shaft of said tension roller while said belt support rollers are disposed within said main body.

* * * * *